US007926199B2

(12) United States Patent
Aaron

(10) Patent No.: US 7,926,199 B2
(45) Date of Patent: Apr. 19, 2011

(54) BUILDING MATERIAL SEPARATOR WITH IMPROVED DYNAMIC AIR FLOW

(75) Inventor: James F. Aaron, Franklin, PA (US)

(73) Assignee: SmartStix, LLC, Franklin, PA (US)

( * ) Notice: Subject to any disclaimer, the term of this patent is extended or adjusted under 35 U.S.C. 154(b) by 309 days.

(21) Appl. No.: 12/378,872

(22) Filed: Feb. 20, 2009

(65) Prior Publication Data

US 2009/0206223 A1 Aug. 20, 2009

Related U.S. Application Data

(60) Provisional application No. 61/066,380, filed on Feb. 20, 2008.

(51) Int. Cl.
*F26B 25/00* (2006.01)

(52) U.S. Cl. ..... 34/239; 34/38; 34/94; 34/518; 248/346.02

(58) Field of Classification Search ..... 34/518, 34/396, 239, 38, 94; 414/14; 206/599; 248/346.02
See application file for complete search history.

(56) References Cited

U.S. PATENT DOCUMENTS

| | | | | |
|---|---|---|---|---|
| 3,509,005 | A * | 4/1970 | Hartig | 428/34.2 |
| 3,907,130 | A | 9/1975 | Hutcheson | |
| 4,788,777 | A | 12/1988 | Davis | |
| 5,722,626 | A | 3/1998 | Menchetti et al. | |
| 5,813,137 | A | 9/1998 | Townsend | |
| 5,860,369 | A * | 1/1999 | John et al. | 108/57.26 |
| 6,134,803 | A | 10/2000 | Gilchrist et al. | |
| 6,179,273 | B1 * | 1/2001 | Edmunds et al. | 256/13.1 |
| 6,283,044 | B1 * | 9/2001 | Apps | 108/57.25 |
| 7,003,898 | B2 | 2/2006 | Aaron | |

* cited by examiner

*Primary Examiner* — Amy J Sterling
(74) *Attorney, Agent, or Firm* — David G. Oberdick

(57) ABSTRACT

A separator for separating stacked sheets of lumber or other building materials. The separator comprises a substantially planar top and bottom surface; the top and bottom surfaces extending substantially parallel to one another. The separator further comprises two side surfaces, each with outwardly protruding side edges for preventing the separator from resting on either side surface; and a front side and a back side substantially parallel to the front surface. A plurality of channels extend into the top and bottom surfaces with the channels defining a plateau, coexistent with the top and bottom surfaces, between adjacent channels. Each channel has one or more apertures for creating a substantially vertical airflow passage between top and bottom surfaces of the separator.

18 Claims, 4 Drawing Sheets

BUILDING MATERIAL SEPARATOR WITH IMPROVED DYNAMIC AIR FLOW

CROSS-REFERENCE TO RELATED APPLICATION

This application claims priority under 35 U.S.C. §119(e) to provisional application Ser. No. 61/066,380, filed Feb. 20, 2008, incorporated herein by reference in its entirety.

FIELD OF THE INVENTION

The present invention relates to a device for separating building materials including sheets or boards of lumber during drying and/or storage. This invention may be used to separate adjoining sheets of other materials, particularly products like drywall, gypsum board, pre-fabricated doors, etc. The separator/stick device of this invention exhibit provides improve dynamic air flow throughout when situated between adjoining layers of product.

BACKGROUND OF THE INVENTION

Numerous devices have been conceived for placing between adjacent boards and/or sheets of lumber products. Such devices are meant to separate the boards between which they are positioned for promoting better drying of wood in a kiln, among other reasons. Such separators, sometimes called "stickers", also enhance airflow between stacks of materials that have already been kiln dried. Preferred separator/sticker devices are made from materials that will minimize the possibility of leaving residual marks on the products they are used to separate for a given time.

In Hutcheson U.S. Pat. No. 3,907,130, there is disclosed a kiln sticker, or "crosser", with generally crescent-shaped, top and bottom load bearing surfaces for lumber separation. The top surface 16 to the sticker at FIG. 4 has a flattened crest. Some air passage is provided with the inverted V-shape base to each sticker/crosser.

In Davis U.S. Pat. No. 4,788,777, the respective stickers are shown as elongated hollow extrusions, preferably made from a synthetic resin with fiberglass reinforcement. While these stickers may have the various cross-sectional shapes shown in FIGS. 2 through 4, none of these shapes provide airflow through or about the stickers themselves.

Menchetti et al., U.S. Pat. No. 5,722,626 discloses separating stacks of product with reusable devices. The wavy risers shown in FIGS. 2 and 3 can be made from recycled wood chips, plastic and/or gypsum. For better reinforcement between layers, alternate embodiments like those in FIGS. 9 through 11, include intermediate strengtheners. None of these riser designs provide for air passage through same, or from side-to-side.

Townsend, U.S. Pat. No. 5,813,137, discloses a modified separator, with transverse grooves, for use in separating pieces of lumber. These separators are distinguishable, though, by their sharply peaked ridges or protrusions and broader grooves in between—which limit surface contact between the separators and stacked lumber. However, this limitation on surface contact can cause warping in the separated lumber. In addition, when wood separators are used with the Townsend separator, the separated wood can be damaged by staining resulting from wood wicking or soaking, i.e., the peaked ridges or protrusions leave a mark on the separated wood.

The flexible wood stickers of Gilchrist et al., U.S. Pat. No. 6,134,803 are made from high molecular weight polyethylene. At the ends, these stickers have an X-shaped cross-section with rounded edges. But at various longitudinal points, each sticker has an inclined, cut groove leading to the helical configuration of FIGS. 3 through 7 when rotated 90, 180 and 270 degrees about its central axis.

The present invention represents an improvement over the lumber sticker of commonly owned U.S. Pat. No. 7,003,898. That prior configuration included elongated, generally rectangular-shaped blocks with a series of diagonal channels and platforms along their top and bottom surfaces. Preferred embodiments included arcuate side surfaces for precluding lumber from resting on either side when stacked between adjoining lumber layers.

SUMMARY OF THE INVENTION

A device for separating stacked sheets of lumber or other building materials. The separator comprises a substantially planar top and bottom surface; with the top and bottom surfaces extending substantially parallel to one another. The separator further comprises two curved side edges, each with outwardly extending protuberances for preventing the separator from resting on either side surface; a front end and a back end substantially parallel to the front end. A plurality of channels extends into the top and bottom surfaces with a plateau between adjacent channels. Each channel has one or more apertures for creating an airflow passageway between top and bottom surfaces. Preferably, the channels preferably extend at angle across the width of the top and bottom surfaces.

BRIEF DESCRIPTION OF THE DRAWINGS

Further features, objects and advantages of this invention will become clearer from the following detailed description of preferred embodiments made with reference to the accompanying drawings.

DETAILED DESCRIPTION OF PREFERRED EMBODIMENTS

For the purpose of promoting this invention, reference will be made to the multiple embodiments illustrated in the accompanying drawings. In these drawings, common elements are commonly numbered but in the next hundred series. Furthermore, although several embodiments are described, it will be apparent to one of ordinary skill in the art that modifications and variations may be made without departing from what is regarded as the subject matter of this invention.

Figure 1:
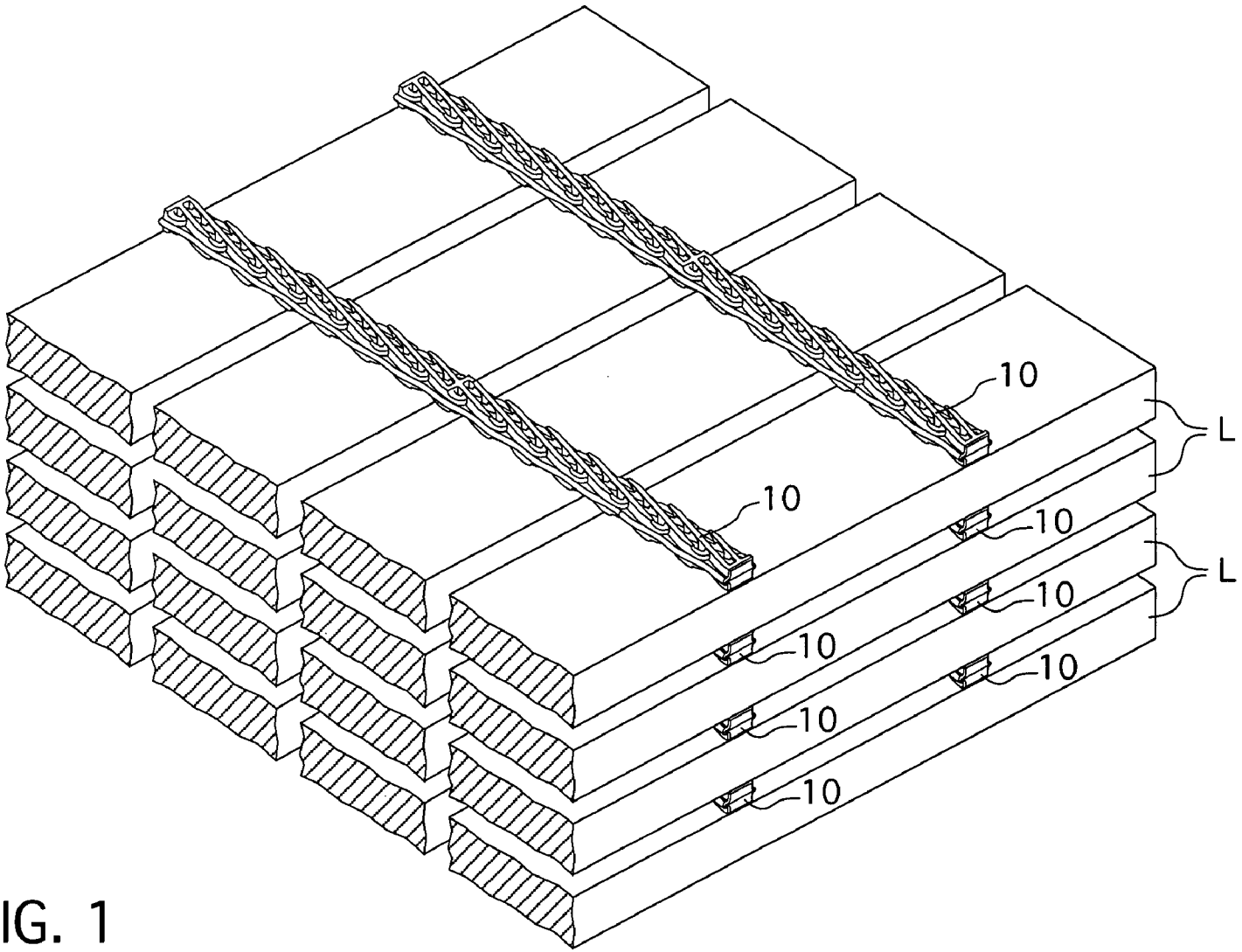
FIG. 1 shows a perspective, partial cutaway view of a stack of lumber with a plurality of separators between layers.

The present invention is an improved separator for separating elongated wood boards, sheets of lumber and/or other building materials. In the wood separating context, any such lumber separator device is also referred to as a "lath," "stick," "crosser," or "sticker". Most often, such separator devices are used, in groups, to separate pieces of lumber in a stack or bundle and allow air to flow land moisture to escape between adjoining layers of material. FIG. 1 shows one representative stack of lumber L with multiple separators, generally 10, situated there between. In FIG. 1, two such separators 10 are shown together in longitudinal alignment between layers of lumber L. Separators 10 may or may not be mechanically or materially interconnected.

Referring now to FIGS. 2 through 6, there is shown a first embodiment of separator 10. In this embodiment, separator or "sticker" 10 includes a substantially planar first (or top) surface 12 and a substantially planar second (or bottom) surface 14. These surfaces are interchangeable in use. For ease of manufacture and better end use implementation, it is preferred that top surface 12 of separator 10 extend substantially parallel to bottom surface 14. In addition, both surfaces 10 and 12 preferably have a non-slip surface.

Figure 3:
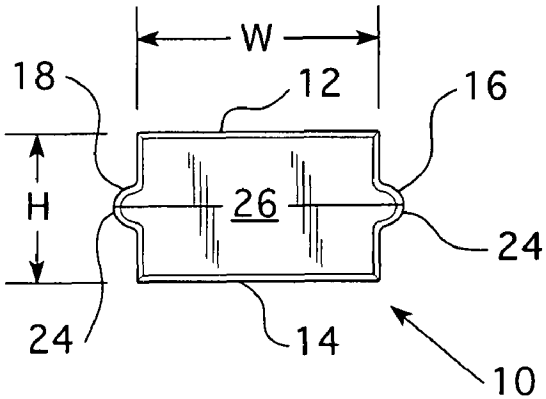
FIG. 3 shows a front view of one lumber separator from FIG. 2.

Each separator 10 of the present invention has an overall, elongate stick-like shape or rectangular profile, with substantially six "sides". When viewed along the longitudinal axis, the front and back surfaces of separator 10 have a relative height and width. As shown in FIG. 3, these dimensions are identified with the effective width W being the shortest horizontal measurement taken at a right angle between edges 16 and 18. The corresponding effective height H is the vertical distance between top surface 12 and bottom surface 14. In one embodiment, separator 10 has an effective width W that is at least about 1.5 times its effective height H. In still other embodiments (not shown), effective width W may be 2, 3 or even 4 times the effective height H.

In one embodiment of the present invention, protruding edges 16 and 18 extend outwardly from the near midpoint of the sides of separator 10, with such edges having a vertical height that is less than the vertical height H measured as the distance between the top and bottom surfaces. The ratio of the edge height to the total height of separator 10 is about 1:3 in a preferred embodiment but can vary in a range of about 1:2 to about 1:6 or more. In this manner, edges 16 and 18 extend outwardly about 180 degrees apart from one another, or roughly at the 3 o'clock and 9 o'clock positions when viewed from either end (as per accompanying FIG. 3).

Figure 2:
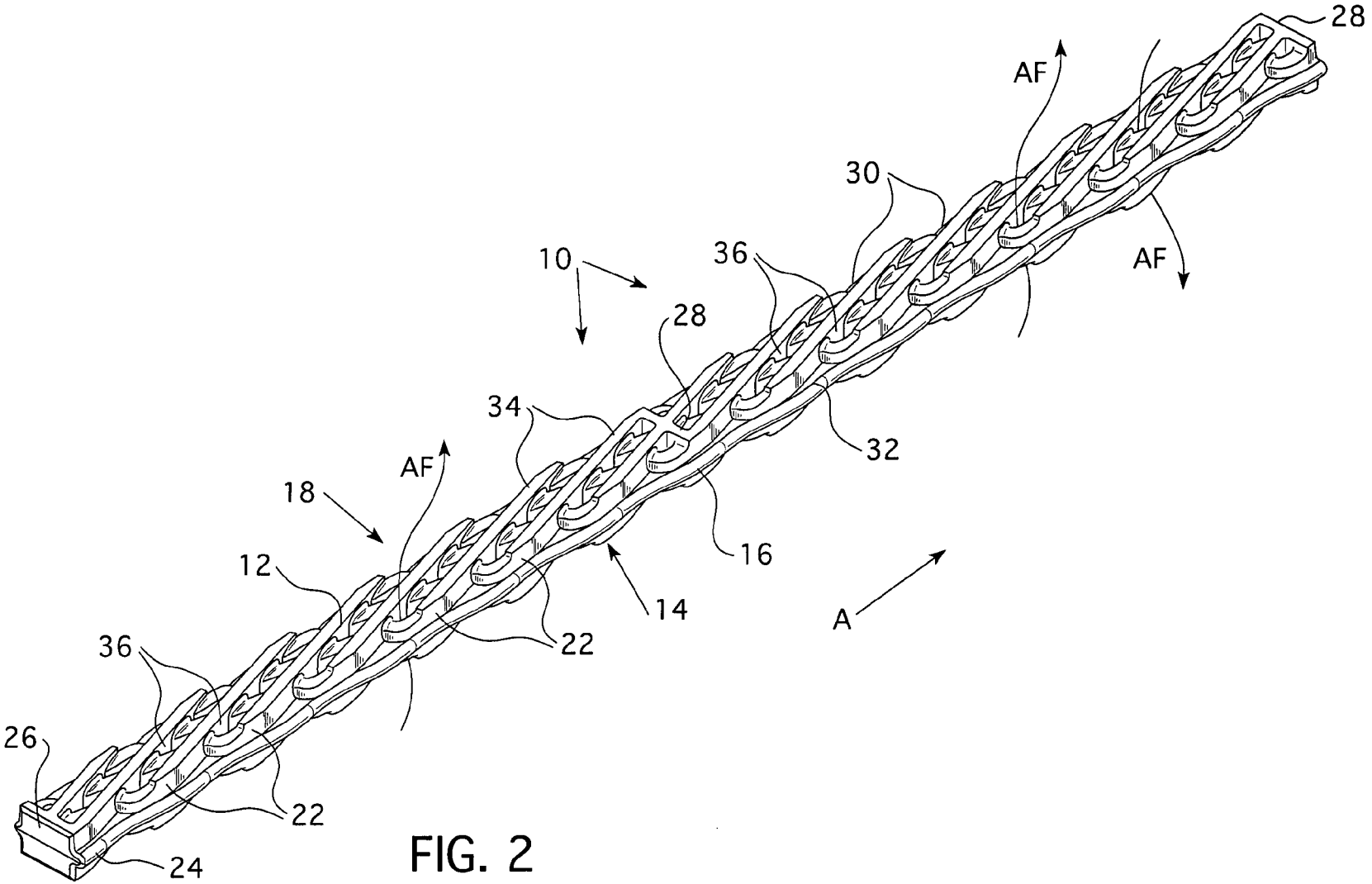
FIG. 2 shows a top perspective view of two lumber separators according to the first embodiment, said separators shown in longitudinal alignment.
Figure 5:
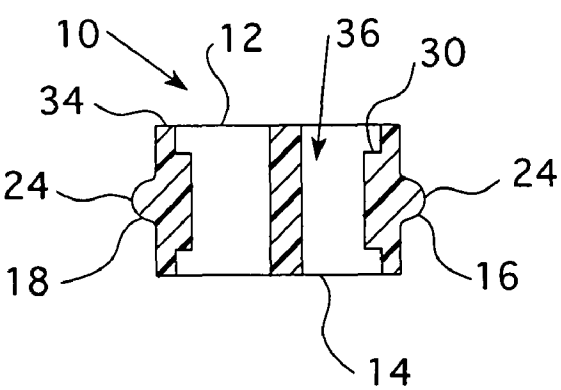
FIG. 5 shows a front sectional view of one lumber separator taken along lines V-V of FIG. 4.
Figure 4:
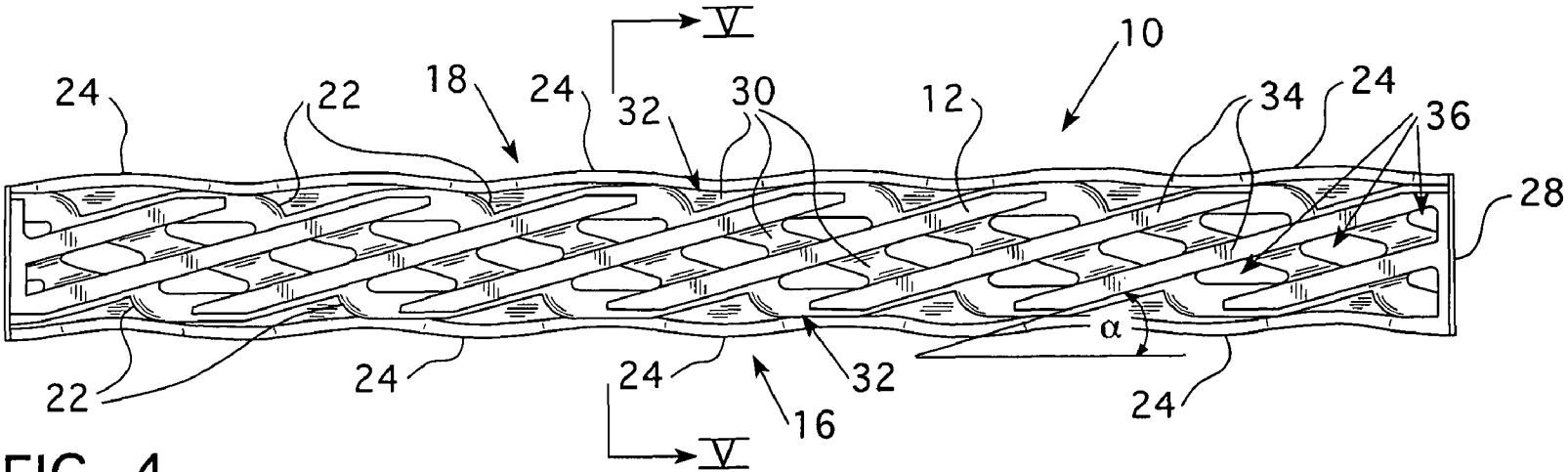
FIG. 4 shows a top plan view of the one lumber separator from FIG. 3.
Figure 6:
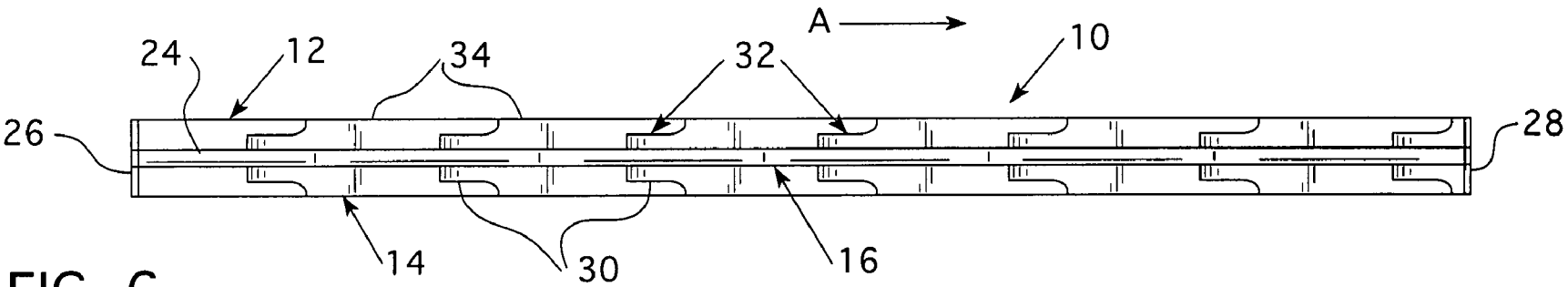
FIG. 6 shows a right side view of the one separator from FIG. 4.

Although the protruding side edges are preferably mirror images of one another, protruding side edge 16 is identified as the closer side edge in full view in accompanying FIGS. 2 and 6, with the reverse protruding side edge 18 better seen in accompanying FIGS. 3, 4 and 5. Protruding side edges 16 and 18 are preferably rounded. As such, separator 10 will not rest on the protruding side edges and instead will land with either its top surface 12 or bottom surface 14 facing upward when dropped on a substantially planar surface like the uppermost sheet in a growing stack of lumber product L.

One of ordinary skill in the art will recognize that a variety of shapes may be constructed to achieve the self-righting effect of separator 10. In one embodiment, protruding side edges 16 and 18 can be curved or wavy along the axis indicated by Arrow A in FIGS. 2, 4 and 6. In this embodiment, the outermost edges 24 of protruding side edges 16 and 18 are substantially equidistant from the middle of separator 10 and lie along a perpendicular plane substantially parallel to the axis shown by Arrows A. In another embodiment, protruding side edges 16 and 18 can be substantially straight along the same axis.

At both longitudinal ends of each separator 10, there is situated a front end 26 and back (or rear) end 28. Preferably, these front and back ends extend substantially parallel to one another. More preferably, front end 26 and back end 28 extend substantially perpendicular to the top and bottom surfaces of separator 10. As shown in FIG. 6, separator 10 thereby has a generally rectangular shape when viewed from either side.

Alternately, both front end 26 and back end 28 surfaces may be angled relative to top 12 and bottom 14 surfaces so long as their respective angles are kept relatively consistent. With angled front and back surfaces, the resultant separator will more closely resemble a parallelogram in side view (not shown). Consistent angling will accommodate longitudinally aligning the front and back surfaces of adjoining separators should longer sections of separator separators be desired.

In FIG. 1, two separators 10 are so aligned, end to end. Although not required, the front and back ends 26 and 28 of the separator 10 may each be provided with means for interconnecting (not shown). Such means can be mostly mechanical, i.e., with tongue-and-groove connectors, snaps and the like. Alternately, length-to-length separator connections may be made chemically by other "temporary" joinder means. In either event, when the separators of this invention interconnect for reuse in multiple applications, fewer varieties (i.e. lengths) of separators need to be kept in stock for incremental separation of lumber and/or other building products. In the embodiments of the present invention where separator 10 is comprised of molded plastic, a single separator 10 is created with a long length and with subsectional separator pieces within that are defined by molded end pieces 26 and 28. More specifically, cuttable sections or gussets, with a cut line at a ninety degree angle, are defined at intervals in a long single separator 10 which, when cut, creates ends 26 and 28 on a smaller separator section. As a result, the longer molded separator can be cut into smaller sections with defined ends 26 and 28 for each subsection. By way of example, separator 10 can initially be molded or otherwise manufactured to a length of eight (8) feet or ninety-six (96) inches, with cuttable gussets defined at every foot or twelve inch increment. A user can cut the longer separator 10 into two smaller separators having a length of four (4) feet or forty-eight (48) inches and down to lengths of one foot. The defined ends 26 and 28 for each subsection are cut at a ninety degree angle to the length of separator so as to provide for smooth ends on each cut separator 10 and eliminate jagged ends which might cut or injure the user of the separator 10.

In the embodiment at FIGS. 2 through 6, both top surface 12 and bottom surface 14 of separator 10 include a plurality of substantially parallel channels 30. Preferably, these channels 30 cross the width of separator 10 and extend from edge 16 to edge 18, effectively ending in a series of spaced notches 32 when viewed from either side (see, FIGS. 1 and 6). Between adjacent channels 30, there is a raised area or plateau 34. Most often, plateaus 34 are coextensive with top surface 12 and/or bottom surface 14 into which channels 30 are cut or integrally formed or molded. The ends 22 of plateaus 34 are rounded to avoid sharp edges that might cut or injure a user of the separator 10. The relative width of plateaus 34 depends on the strength of material chosen to construct separator 10, the hardness of lumber (or other building material) being separated and supported, and the desire to minimize or avoid marking on the stacked materials (sometimes called "shadows"). The narrower the relative width of plateaus 34, the greater the surface area of lumber or other sheet product exposed to ambient or kiln air, and the less likely there will be leftover or remnant shadows. In the present invention, extremely narrow ridges or projections for plateaus 34 are avoided, though, because of concerns for providing adequate support to separated lumber. Dynamic air flow is otherwise facilitated by one or more apertures 36 in each channel 30, which extend substantially vertically through separator 10 and act to improve air flow as compared to prior separator devices (discussed below).

In the representative lumber separator 10 shown in accompanying FIGS. 2-6, the ratio between the width of plateaus 34 and width of channels 30 is about 1:2. Other ratios are possible, including, but not limited a range of about 1:1 to about 1:4. The ratio between the depth of each channel 30 and the width of each channel is also about 1:2, although ratios are again possible, including about 1:1 to about 1:4. More precise dimensions depend upon the overall size of separator 10.

Preferably, each channel 30 diagonally crosses the entire width of top and bottom surfaces at an angle $\alpha$ as shown in FIG. 4. In a preferred embodiment, this angle is about thirty degrees or less relative to the longitudinal axis (i.e., overall length) of separator 10. Such an angle is designed to maximize cross-grain support for stacked lumber while also facilitating air flow. Preferably, the parallel channels 30 in top surface 12 run in the same direction and location as the parallel channels 30 in bottom surface 14. This location of channels 30 in the top and bottom surfaces facilitates the role of apertures 36 in providing dynamic air flow and improving the overall air circulation provided by separator 10. As a result, the plurality of apertures 36 extending along various points in each respective channel 30 provide dynamic airflow between top surface 12 and bottom surface 14 as shown by airflow arrows AF in FIG. 2.

The number, placement and shape of apertures 36 can vary. In the representative separator 10 of FIGS. 2 through 6, there are three apertures 36 per channel 30 with the general aperture shape being rectangular or diamond-like when viewed from above or below. The shape of each aperture 36 can also vary and is determined, in part, by the manufacturing and/or molding process employed for making separators according to this invention. For instance, when polymer molds are used to make resin-based separators 10, such molds will typically employ simpler shaped means for integrally forming and/or quickly punching out a plurality of common aperture shapes. Should greater directional airflow be desired, preferred deflection pathways can be added through a separator 10, with round, oval or tubular apertures situated between top and bottom surfaces. Unfortunately, the more specified the path of airflow becomes, the less flexibility there is in positioning separators between adjoining product layers. Multiple separators will not be as easily rotated or flipped upside down and still properly function in highly customized, airflow applications.

In an alternate embodiment (not shown), channels may traverse the width of top surface 12 in a first direction, then traverse the width of bottom surface 14 at a ninety degree angle relative to the channels in said top surface. When viewed from above, the channels in these respective surfaces will run perpendicular to each other, forming a relative basketlike weave, or crisscross pattern of channels, with apertures 30 located where the channels intersect.

Still other channel configurations may promote the desired direction of airflow in a stack of lumber or other building products. It may be practical to use separators with channels that run substantially parallel, or perhaps even perpendicular to their longitudinal axes. Respective separators may also include one continuous channel formed in both planar (top and bottom) surfaces, such as a single helix, with adjacent, channels on either side sufficiently separated by a structurally supportive, intermediate plateau. Still other shapes and configurations may provide customized airflow movements through alternate embodiments.

The aforementioned lumber separators/stickers may be made of any type of material capable of resisting the compressive pressures associated with stacking various building materials. In the event such separators are placed between layers of lumber product for drying in a kiln, they will need to be made from materials that are resistant to prolonged and/or repeated elevated temperature exposure. For those applications, any durable, heat resistant material can be used such as plastic (e.g., polyethylene, polyurethane, or polystyrene), wood, fiberglass, resin compounds (such as polycarbonate), metals, composites and combinations thereof. If corrosion is an issue with the building materials to be separated, or if stacks of materials may require periodic treatments with known chemicals, there may be fewer options with which to make the separator devices of this invention. In one embodiment of the separator of the present invention, separator 10 is made of molded plastic and, preferably, polypropylene, although other plastics can be used. In this embodiment, black, UV-resistant plastic provides beneficial properties for separator 10. It is also possible to use recycled plastic. Plastic is preferable because it avoids staining the separated wood and also because it is more durable and long-lasting (it is less prone to breaking or warping).

In one embodiment, the separator is made from a plastic such as polypropylene that has been combined with fiberglass and, optionally, talc, mica or other similar filler. This type of material is readily available for purchase, often as pellets, and known to one skilled in the art. In such material, the amount of fiberglass is typically equal to or above about 5 wt. %, 10 wt. %, or 15 wt. % and less than or equal to about 45 wt. %, 40 wt. % or 35 wt. %. When used, filler is present in amounts of less than or equal to about 20 wt. %, typically less than or equal to about 15 wt. % or 10 wt. %. When talc, mica or other filler is present, it is typically used in amounts of greater than or equal to about 2 wt. %, 3 wt. %, 4 wt. % or 5 wt. %.

The separator is formed by melting the pellets and then molding the material into the desired shape, by injection molding, extrusion, or other method. The talc, mica or other similar filler helps to align the fiberglass particles during the molding process to provide improved strength and reduced shrinkage in the final product. The fiberglass particles provide sheering action in the plastic and improved durability and longitudinal strength.

What is claimed is:

1. A separator for separating adjacent layers of planar building materials, said separator comprising: a substantially planar top surface; a substantially planar bottom surface, said bottom surface being substantially parallel to said top surface; two side surfaces, each side surface having an outwardly protruding side edge for preventing said separator from resting on either side surface; a front side and a back side; and a plurality of channels extending into said top and bottom surfaces, said channels defining a raised plateau extending between adjacent channels and co-existent with said top and bottom surfaces, and each channel having at least one aperture for creating a substantially vertical air flow passageway between said top and bottom surfaces.

2. The separator of claim 1, wherein said outwardly protruding side edges are about 180 degrees apart.

3. The separator of claim 1, wherein said outwardly protruding side edges extend from about a midway point of each side surface.

4. The separator of claim 1, wherein said channels extend across said top and bottom surfaces and from one said side surface to the other said side surface.

5. The separator of claim 1, wherein said channels in said top and bottom surfaces extend substantially parallel to one another.

6. The separator of claim 1, wherein said channels extend across said top and bottom surfaces in a diagonal direction.

7. The separator of claim 6, wherein said diagonal has an angle of about thirty degrees or less as measured in respect to the longitudinal axis of said separator.

8. The separator of claim 1, wherein each channel has multiple apertures between said top and bottom surfaces.

9. The separator of claim 1, wherein said front and back sides are substantially parallel.

10. The separator of claim 1, wherein each front and back side includes means for interconnecting adjacent separators.

11. The separator of claim 1, wherein said separator is made from a material selected from the group consisting of plastic, metal, wood, fiberglass, resin, composite and combinations thereof.

12. The separator of claim 1, wherein the vertical height of said separator is less than the horizontal width of said separator.

13. The separator of claim 1, wherein the ratio between the width of said plateaus and width of said channels 30 is about 1:1 to about 1:4.

14. The separator of claim 1, wherein the ratio between the depth of said channels and the width of said channels is about 1:1 to about 1:4.

15. The separator or claim 1, wherein said side edge has a vertical height that is less than the vertical height of said separator.

16. The separator of claim 15, wherein the ratio between the vertical height of said side edge to the vertical height of said separator is about 1:2 to about 1:6.

17. The separator of claim 1, wherein said separator is formed to allow for cuttable subsections, each subsection defined by cuttable gussets in the formed separator, said cuttable gussets operable to provide flat front and back sides after cutting.

18. The separator of claim 1, wherein the separator is formed from a material comprising plastic and fiberglass, and, optionally, a filler.

* * * * *